US007895996B2

(12) United States Patent
Grove

(10) Patent No.: US 7,895,996 B2
(45) Date of Patent: Mar. 1, 2011

(54) ILLUMINATING REAR BOW SIGHT WITH SELF CONTAINED POWER AND LIGHT SOURCE

(76) Inventor: Jeff Grove, Dover, PA (US)

( * ) Notice: Subject to any disclaimer, the term of this patent is extended or adjusted under 35 U.S.C. 154(b) by 377 days.

(21) Appl. No.: 11/759,500

(22) Filed: Jun. 7, 2007

(65) Prior Publication Data

US 2008/0302348 A1 Dec. 11, 2008

(51) Int. Cl.
*F41G 1/467* (2006.01)

(52) U.S. Cl. ..... 124/87; 33/265

(58) Field of Classification Search ..... 124/87, 124/90; 33/265; 362/200
See application file for complete search history.

(56) References Cited

U.S. PATENT DOCUMENTS

| | | | | |
|---|---|---|---|---|
| 4,220,983 | A | 9/1980 | Schroeder | |
| 4,495,705 | A | 1/1985 | Kowalski et al. | |
| 5,107,596 | A | 4/1992 | Snyder | |
| 5,148,603 | A | 9/1992 | Beutler | |
| 5,379,748 | A | 1/1995 | Carlson | |
| 5,996,569 | A | 12/1999 | Wilson | |
| 6,299,323 | B1 * | 10/2001 | Yu et al. | 362/116 |
| 6,981,329 | B1 | 1/2006 | Strathman | |
| 7,040,027 | B1 | 5/2006 | Shaffer et al. | |
| 2003/0019118 | A1 | 1/2003 | Wilson | |

* cited by examiner

*Primary Examiner* — John Ricci

(57) ABSTRACT

An illuminating rear bow sight with a self contained illumination means and power source is disclosed. The sight hereby satisfies the need of archers and hunters for a less cumbersome, quieter and more efficient rear bow sight that will provide a clear view of the target and sighting pins and enable a more accurate shot downrange. This sight is mounted directly within the strings of a multi-string bowstring. The power source contained internally in the structure of the disclosed rear bow sight is a stick-type battery with an LED light mounted to the end of said battery. The target is sighted over a V-shaped portion of the sight, which is illuminated via internal LED light to allow the shooter a clearer view of the target and sighting pins.

3 Claims, 2 Drawing Sheets

ILLUMINATING REAR BOW SIGHT WITH SELF CONTAINED POWER AND LIGHT SOURCE

FEDERALLY SPONSORED RESEARCH

Not Applicable.

CROSS REFERENCE TO RELATED APPLICATIONS

Not applicable

SEQUENCE LISTING OR PROGRAM

Not Applicable.

BACKGROUND

The earliest concrete evidence of archery dates back approximately 5,000 years. The bow probably originated for use in hunting and was then adopted as a tool of warfare. Bows eventually replaced the atlatl (spear-thrower) as the predominant means for launching projectiles. Classical civilizations, notably the Persians, Macedonians, Nubians, Greeks, Parthians, Indians, Chinese, and Koreans, fielded large numbers of archers in their armies. Arrows proved exceptionally destructive against massed formations and the use of archers often proved decisive. Archers sometimes rode on horseback, combining range with speed.

Archery has advanced much since these early days of human civilization. Much of the archery done today is for sport, either as a weapon for hunting game, or in competition in such events as the Pan American and Olympic Games, or intercollegiate and local contests.

These sporting events, specifically while hunting game, may require the archer to operate the bow in low-light conditions. To ensure proper targeting and trajectory of the arrow, certain sighting processes and devices have been developed over time to improve accuracy and precision of the released arrow. One such sighting device comprises a rear bow sight installed within multi-string bowstrings, and sighting pins installed on the bow itself. As the archer sets the arrow, and draws the arrow and bowstring rearward in a typical fashion, the rear bow sight and sighting pins are aligned to ensure accuracy of released arrow to the target at a determined distance downrange.

However, this sight pin/rear bow sight combination is difficult to operate in low light conditions. Lighted sighting pins have been developed in the past for both archery and for fire arms and are not claimed herein. Additionally, rear bow sights have been developed in the past and this basic concept is not claimed herein. Specifically, rear bow sights have even been marketed that claim to illuminate via battery power. The down side of this technology arises because traditionally the battery to enable such illumination is attached to the body of the bow, and a cord within which the power is provided stretches from the bow to the rear bow sight located within the multi-string bowstring. This encumbers the archer when the bowstring is drawn rearward into the shooting position. Additionally, the power cord attached between the bow and the bowstring will slow and alter the path of the bowstring upon its release by the archer when shooting the arrow. This in turn may affect the course of the arrow, or change the range and trajectory of the arrow and therefore reduce accuracy to the target.

Additionally, a problem many hunters and archers encounter when using such sighting systems in low-light conditions is blurring of the sights when illumination means are installed into the rear bow sight. This essentially blurs the archer's vision of both the target and the sighting pins used in conjunction with the rear bow sight. The shape of the rear bow sight and positioning of the lighting means within the rear bow sight becomes critical to the effective and accurate operation of the sighting system used by the archer.

Moreover, when used in the sport of game hunting, any person skilled in the art is aware that silence, or near-silence, is critical to success. When an illuminated rear bow sight is used, it is not favored to leave the apparatus lit as this will drain the attached battery and may even attract attention to the hunter. The hunter will typically switch the illumination means within the rear bow sight into the on position as the bow is readied to shoot at the target. Therefore, it is imperative to the success of the hunter to quietly engage the illumination on the rear bow sight when maneuvering into a shooting position. A silent switch on the rear bow sight is essential for any hunter.

Information relevant to attempts to address these problems can be found in U.S. Pat. Nos. 4,220,983, 4,495,705, 5,080,084, 5,107,596, 5,148,603, 5,379,748, and 5,339,227, as well as U.S. patent application, Publication No. 2003/0019118. However, each one of these references suffers from one or more of the following disadvantages: (1) the battery to enable illumination of a rear bow sight is attached to the body of the bow and a power cord stretches from the bow to the rear bow sight located within the bowstring, thus encumbering the archer when the bowstring is drawn rearward into the shooting position, as well as slowing and altering the path of the bowstring upon release of the arrow by the archer; (2) blurring of the sighting pins and target occurs when the rear bow sight is illuminated; and (3) sound is created when the archer activates the illumination means.

For the foregoing reasons, there is a need for a less cumbersome, quieter and more efficient rear bow sight for archers and hunters that will provide a clear view of the target and sighting pins and enable a more accurate shot downrange.

SUMMARY

The present invention is directed to an apparatus that satisfies this need of archers and hunters and provides a less cumbersome, quieter and more efficient rear bow sight that provides a clear view of the target and sighting pins and enables a more accurate shot downrange. The rear bow sight having features of the present invention attaches within the strings of a multi-string bowstring and comprises a body member and a switching member, both designed to be capable of being connected via an interlocking means, a battery which is self contained within the rear bow sight device and an LED light unit, also self contained with the rear bow sight.

In one such embodiment, the body member is opaque in clarity, and is of a shape capable of being fastened to the switching member, and an upper end of the body member is formed into a V-shaped configuration suitable for viewing the sighting pins. The body member comprises a solid structure, and a battery/LED channel is fashioned located along the longitudinal center of the body member. The battery/LED channel is of such a radius to allow insertion of the battery and LED unit, and is tapered at its upper most section to a diameter sufficient to temporarily hold the LED unit in a temporarily fixed position. In the preferred embodiment, the shaft of the bore is drilled to a radius approximately equal to a number nineteen (#19) drill bit, and the end of said bore used to temporarily fix the LED is narrowed to a radius approximately equal to a number twenty-three (#23) drill bit.

The switching member is opaque in clarity, and of a shape capable of being fastened to the body member in an interlocking fashion. This may resemble the interlocking ends of the body member and the switching member being generally U-shaped in appearance. The switching member will have a shallow bored hole of a sufficient diameter to securely hold the battery unit and LED fixture. In one embodiment, the switching member is U-shaped or V-shaped, and when it, along with the inserted battery and LED fixture are inserted into the aforementioned bored hole found within the body member, and the LED is secured within the aforementioned narrowing of the bored hole, the switching member can be pulled slightly inward and outward to engage the illumination means.

The battery and light fixture comprises a stick-type battery and a small LED light device. In the preferred embodiment, the battery is a three volt (3V) lithium battery stick of approximately 1.5 inches in length and approximately 4 millimeters in diameter. The LED light device is affixed directly to the end of the battery stick, said combination including a switching means whereby the user can push the LED light device in or pull the LED light device outward to activate or deactivate the illumination means.

A feature of the body member comprises a clarity in the opaque finish of said body member. This enables the body member to show the illumination coming from the internally located LED. This clarity is V-shaped in nature, and oriented to match the V-shaped view area of the body member discussed below. In the preferred embodiment and best mode, this transparent area is approximately 1/32" in width, and located approximately 1/16" from the top viewing portion of the body member.

Another feature of the body member comprises a V-shaped cut in the upper portion of said body member whereby the user will view the sighting pins used in conjunction with the rear bow sight. This feature, in combination with the illumination means, prevents blurring of the sighting pins and target.

DESCRIPTION OF THE DRAWINGS

The drawings presented hereafter are to be used together with the description and appended claims to explain the inventive aspects of the invention, and representative examples of the embodiments herein. The drawings are not to be construed as limiting the invention to only the illustrated and described embodiments.

REFERENCE NUMERALS IN DRAWINGS

Figure 1:
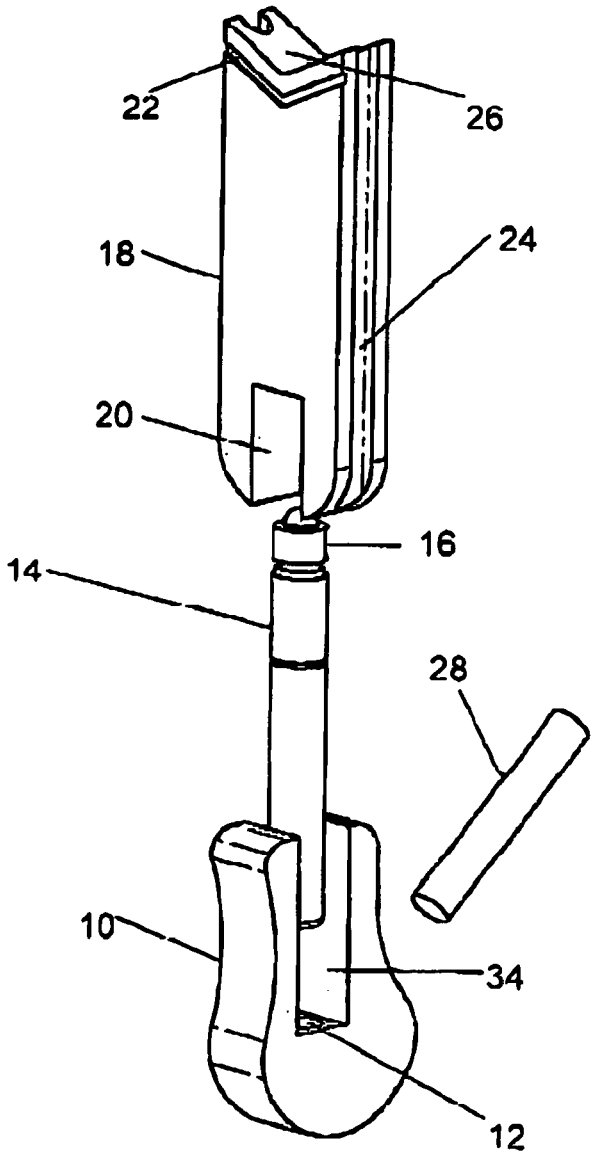
FIG. 1 is an exploded perspective view of the rear bow sight device.

10 Switching member
12 Battery housing
14 Battery
16 LED unit
18 Body member
20 Body member interconnection means
22 Transparent V-shaped cuts
24 Attachment grooves
26 View area
28 Stabilizing peg
30 LED housing
32 Battery/LED Channel
34 Switching member interconnection means

DESCRIPTION

The reader's attention is directed to all papers and documents which are filed concurrently with this specification and which are open to public inspection with this specification, and the contents of all such papers and documents are incorporated herein by reference. All features disclosed in this specification (including any accompanying claims, abstract or drawings) may be replaced by alternative features serving the same, equivalent or similar purpose, unless expressly stated otherwise. Thus, unless expressly stated otherwise, each feature disclosed is one example only of a generic series of equivalent or similar features.

As shown in FIG. 1, a rear bow sight device having features of the present invention attaches within the strings of a multi-string bowstring by use of shallow attachment grooves 24 etched along both sides of a body member. The rear bow sight device comprises the body member 18 and a switching member 10, both designed to be capable of being connected via an interlocking means 20, 34, a battery 14 which is self contained within the rear bow sight device and an LED light unit 16, also self contained with the rear bow sight, and finally a stabilizing peg 28. The body member 18 is formed such that the top end of said body member 18 is cut with a view area 26. Preferably and in the best mode said view area 26 may be a V-shaped groove in the body member 18. The body member 18 may have an interconnecting means 20 to enable connection with the switching member 10, and the switching member 10 may have a matching interconnecting portion 34 enabling the two units to be joined in an interlocking fashion.

Figure 2A:
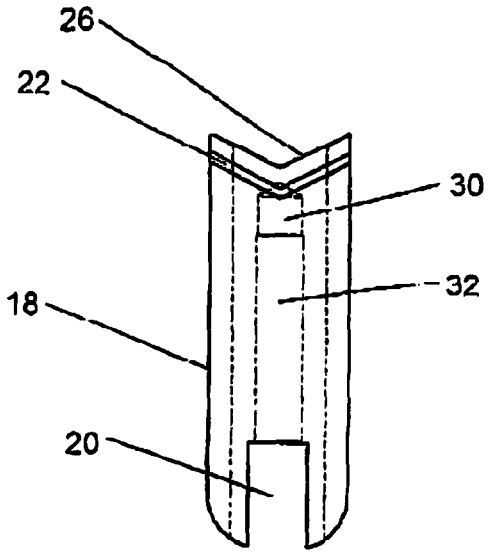
FIG. 2A is an elevation side view of the housing member showing internal LED housing.

As shown in FIG. 2A, the body member 18 is opaque in clarity, and is of a shape capable of being fastened to the switching member 10, and an upper end of the body member 18 is formed into a V-shaped configuration suitable for viewing the sighting pins. The body member 18 comprises a solid structure, and a battery/LED channel 32 is bored within said body member 18 located along the longitudinal center of the body member 18. The battery/LED channel 32 is of such a radius to allow insertion of the battery 14 and LED unit 16, and a LED housing 30 is fashioned at the battery/LED channel's 32 upper most section to a diameter sufficient to temporarily hold the LED unit 16 in a temporarily fixed position. In the preferred embodiment, the shaft of the battery/LED channel 32 is drilled to a radius approximately equal to a number nineteen (#19) drill bit, and the LED housing 30 used to temporarily fix the LED unit 16 is narrowed to a radius approximately equal to a number twenty-three (#23) drill bit.

Figure 2B:
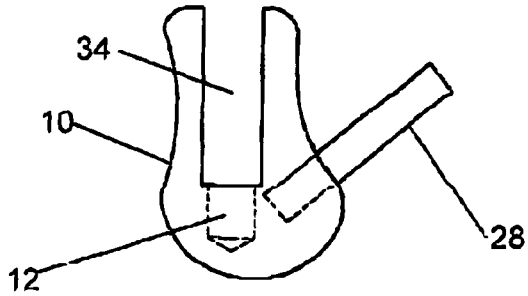
FIG. 2B is an elevation side view of the switching member showing internal battery housing.

As shown in FIG. 2B, the switching member 10 is opaque in clarity, and of a shape capable of being fastened to the body member in an interlocking fashion 34. The switching member 10 will have a battery housing 12, a shallow bored hole of a sufficient diameter to securely hold the battery 14 and LED unit 16 fixtures. In one embodiment, the switching member 10 is U-shaped or V-shaped, and when it, along with the inserted battery 14 and LED unit 16 are inserted into the aforementioned battery/LED channel 32 found within the body member 18, and the LED unit 16 is secured within the aforementioned LED housing 30, the switching member 10 can be pulled slightly inward and outward to engage or disengage the illumination means.

The battery 14 and LED unit 16 comprises a stick-type battery and a small LED light device. In the preferred embodiment, the battery is a three volt (3V) lithium battery stick of approximately 1.5 inches in length and approximately 4 millimeters in diameter. The LED light unit 16 is affixed directly to the end of the battery stick 14, said combination including a switching means whereby the user can push the LED light device in or pull the LED light device outward to activate or deactivate the illumination means.

A further feature of the body member 18 comprises a transparent V-shaped cut 22, represented by a clarity in the opaque finish of said body member 18. This enables the body member 18 to emit the illumination coming from the internally located LED unit 16 or illumination means. This clarity is V-shaped in nature, and oriented to match the V-shaped view area 26 of the body member 18 discussed below. In the preferred embodiment and best mode, this transparent area 22 is approximately 1/32" in width, and located approximately 1/16" from the top viewing portion of the body member.

The previously described versions of the present invention have many advantages, including: providing a less cumbersome, quieter and more efficient rear bow sight that also provides a clear view of the target and sighting pins and enables a more accurate shot downrange. However, the invention does not require that all advantageous features and all the advantages need to be incorporated into every embodiment of the invention. Furthermore, the present invention has been described in considerable detail with reference to certain preferred versions thereof, other versions are possible. Therefore, the spirit and scope of the appended claims should not be limited to the description of the preferred versions contained herein.

What is claimed is:

1. A rear bow sight device for a bow with a multiple stranded bowstring comprising:

a. A transparent body member having means for facilitating attachment to said multiple stranded bowstring, said body member having an end terminating in an edge of V-shaped configuration;

b. An opaque material substantially covering said body member, said opaque material having an opening comprising a pair of slits disposed in a V-shaped arrangement to expose a V-shaped transparent sighting view area in said body member, said V-shaped transparent sighting view area being spaced from said edge of said body member and disposed in alignment corresponding to said V-shaped configuration of said edge of said body member;

c. A battery mounted on said body member;

d. An LED light fixedly mounted on said body member, said LED light being so positioned as to illuminate said generally V-shaped transparent sighting view area; and e. A switching member mounted on said body member and being movable with respect to said body member between a first position wherein said battery is electrically connected to said LED light and a second position wherein said battery is electrically disconnected from said LED light, whereby said V-shaped transparent sighting view area is illuminated by said LED light when said switching member is in said first position.

2. The device of claim 1 wherein said body member further comprises a first generally U-shaped cut-out portion and said switching member further comprises a second generally U-shaped cut-out portion, and wherein said first cut-out portion and said second cut-out portion are in interlocking sliding relationship with one another whereby said switching member is slidably mounted on said body member by said interlocking relationship.

3. The device of claim 1 further comprising an elongated channel in said body member and having a longitudinal channel axis, wherein said battery and said LED light are positioned in said elongated channel in alignment with one another along said longitudinal channel axis, and wherein said switching member is in contact with said battery and said battery is movable in said channel such that when said switching member is in said first position said battery is moved into electrical contact with said LED light and when said switching member is in said second position said battery is moved out of electrical contact with said LED light.

* * * * *